United States Patent [19]

Rhunke

[11] Patent Number: 4,486,011

[45] Date of Patent: Dec. 4, 1984

[54] METHOD AND APPARATUS FOR OPENING MULTI-SHEET PRODUCTS, ESPECIALLY PRINTED PRODUCTS

[75] Inventor: Rolf Rhunke, Wetzikon, Switzerland

[73] Assignee: Ferag AG, Hinwil, Switzerland

[21] Appl. No.: 441,955

[22] Filed: Nov. 15, 1982

[30] Foreign Application Priority Data

Nov. 24, 1981 [CH] Switzerland ..... 7497/81

[51] Int. Cl.[3] ..... B65H 5/30

[52] U.S. Cl. ..... 270/55; 270/57; 271/295

[58] Field of Search ..... 270/55, 57; 271/280–281, 295

[56] References Cited

U.S. PATENT DOCUMENTS

| | | | |
|---|---|---|---|
| 2,384,506 | 9/1945 | Thompson | 270/55 X |
| 2,709,584 | 5/1955 | Kleinberg | 270/55 X |
| 2,873,112 | 2/1959 | Crafts et al. | 270/55 |
| 3,162,434 | 12/1964 | Hepp | 270/57 |
| 3,383,102 | 5/1968 | Paleveda | 270/55 |
| 3,561,751 | 2/1971 | Dutro | 270/55 |
| 3,595,560 | 7/1971 | Hannon et al. | 270/57 |
| 3,951,399 | 4/1976 | Reist | 271/295 X |
| 4,058,202 | 11/1977 | Reist et al. | 271/295 |
| 4,138,101 | 2/1979 | Faltin | 270/57 |
| 4,420,146 | 12/1983 | Reist | 270/55 |

FOREIGN PATENT DOCUMENTS

| | | | |
|---|---|---|---|
| 978441 | 11/1975 | Canada | 270/57 |
| 2749095 | 5/1979 | Fed. Rep. of Germany | 270/55 |
| 6504734 | 10/1965 | Netherlands | 270/57 |

*Primary Examiner*—E. H. Eickholt

*Attorney, Agent, or Firm*—Werner W. Kleeman

[57] ABSTRACT

The printed product to be opened is moved with an open side thereof towards a stationary opening element. The bottom part of the printed product contains at an open side, located opposite to a fold of the printed product, a marginal zone or portion by means of which the sheets of this bottom part protrude past the sheets of the other part of the product. The opening element has an inclined deflector aligned with the protruding marginal zone extending parallel to the direction of product travel. The printed product approaching the opening element is raised by means of a ramp prior to the leading edge of the producing marginal zone or portion abutting against a deflecting face of the deflector. By means of the deflector the sheets having the protruding marginal zone are downwardly deflected and thus are separated from the remaining sheets. An opening is thus formed between the two parts of the product, and a support element arranged after the opening element enters this opening. A retaining or hold-open member follows the support element. The upper part of the product comes to rest on this retaining member, and the printed product thus is maintained in an opened state.

21 Claims, 5 Drawing Figures

1a
1
1b
2
4
15
14
A
12
6
7
13
5
9
8
10
11

1a
1
1b
14
15
M
2
6
7
A
5
12
9
8
10
11

METHOD AND APPARATUS FOR OPENING MULTI-SHEET PRODUCTS, ESPECIALLY PRINTED PRODUCTS

CROSS REFERENCE TO RELATED APPLICATIONS

This application is related to the commonly assigned, copending U.S. application Ser. No. 06/214,460, filed Dec. 8, 1980, entitled "Method and Apparatus for Opening Folded, Bound or Stitched Multi-Sheet Products, Especially Printed Products". This application is also related to the commonly assigned, copending U.S. application Ser. No. 06/214,461, filed Dec. 8, 1980, entitled "Apparatus For Opening Folded, Bound or Stitched Multi-Sheet Products, Especially Printed Products".

BACKGROUND OF THE INVENTION

The present invention relates to a new and improved method of, and apparatus for, opening at least two sheets of a product, especially a printed product, preferably comprising at least one asymmetrically folded sheet in which the two sheets or pages of the folded sheet are interconnected at one side thereof and one of the sheets is formed with a marginal zone or portion protruding past the margin of the other sheet at a further open side thereof.

Generally speaking, the method and apparatus of the present invention comtemplates that the product to be opened is moved relative to an opening device including an opening element and arranging the sheet with the protruding marginal zone or portion such that an open side of the sheet faces the opening element. The opening element is, then, brought into engagement with the protruding marginal zone or region in order to open the sheets.

There are already known to the art different opening methods and apparatuses in which the sheets having the protruding marginal zone or portion are lying on top of the other sheets and are lifted therefrom; see, for instance, British Patent No. 544,365 and U.S. Pat. No. 2,237,740. Above all, particularly in the case of thin products, especially in the case of products or signatures composed of only one asymmetrically folded sheet such lifting of the sheets or pages of the folded sheet presents certain problems. For example, in the apparatus disclosed in British Patent No. 544,365 a recess must be provided in the support for the products into which engages the opening element, in order to ensure that the sheets having the protruding marginal zone or portion are positively gripped and upwardly lifted or deflected even in the case of thin products.

SUMMARY OF THE INVENTION

Therefore, it is a primary object of the present invention to provide a new and improved method of, and apparatus for, reliably and positively opening multi-sheet products, especially printed products, in a manner not associated with the aforementioned drawbacks and limitations of the prior art proposals heretofore discussed.

Another and more specific object of the present invention aims at providing a new and improved method of, and apparatus for, opening multi-sheet products, especially printed products, wherein it is possible to open with very simple means such multi-sheet products in a faultless manner independent of their thickness, without there arising the danger of damaging the product.

Still another important object of the present invention is to provide a new and improved method of, and apparatus for, opening multi-sheet products, especially printed products, wherein it is possible to open with very simple means such multi-sheet products in a faultless and reliable manner independent of the width of the protruding marginal zone or portion.

Now in order to implement these and still further objects of the invention, which will become more readily apparent as the description proceeds, the method aspects of the present development are manifested by the features that the products, viewed with respect to their direction of movement, are raised forwards of the opening element, and the sheets having the protruding marginal zone or portion and located beneath the other sheets are deflected downwardly from the other sheets of the product.

As alluded to above the invention is not only concerned with the aforementioned method aspects, but also relates to a new and improved construction of apparatus for opening such products, wherein, viewed with respect to the direction of travel of the products, the sheets provided with the protruding marginal zone or portion, bear upon a support member. Forwardly of the opening element there is provided a run-on surface or ramp face for the products which ascends in the direction of the opening element. The opening element is arranged in alignment with the marginal zone or portion of the sheets and comprises a deflecting element or deflector arranged to effect a deflection of the sheets having the protruding marginal zone in a direction towards the support member.

Preferably, the opening element is aligned substantially with an imaginary central line extending through the marginal zone or portion in the direction of product travel. The product is raised by the run-on surface or ramp face above the level of the support member by being moved relative to such ramp face. A support element or device may follow the ramp face, so that, while the sheets containing the protruding marginal zone or portion are deflected in the direction of the support member, the other sheets come to rest on the support element or device. The support element is followed by a product retaining or hold-open member arranged approximately at the level of the support element upon which the other sheets rest after having passed the opening device, so that the product is maintained in an opened state after having passed the opening device.

With the invention the sheets not having a protruding marginal zone or portion lie upon the other sheets containing such a protruding marginal zone or portion. Prior to contacting the opening element the product moving relative thereto is raised to a higher level. Consequently, the sheets in the product having the protruding marginal zone or portion can be deflected downwardly towards the support member for the products while passing the opening element, whereby the danger of damage to the separated sheets is excluded. An opening is thus positively formed in a simple manner between the sheets and the formation of this opening is independent of the number of sheets and the thickness of the product.

By appropriately aligning the opening element with the protruding marginal zone or portion the sheets will be safely and positively deflected, and thus, the products will be faultlessly opened even if the width of the protruding marginal zone or portion changes.

The method and apparatus according to the invention for opening two or multi-sheet products is especially, although not exclusively, suited to be combined with apparatus known in the art for handling or processing printed products, such as disclosed in U.S. Pat. No. 3,951,399. The particular design of the apparatus according to the invention enables the same to be subsequently installed into an already existing product handling apparatus without the need for any extensive modifications or adaptations thereof.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 3:
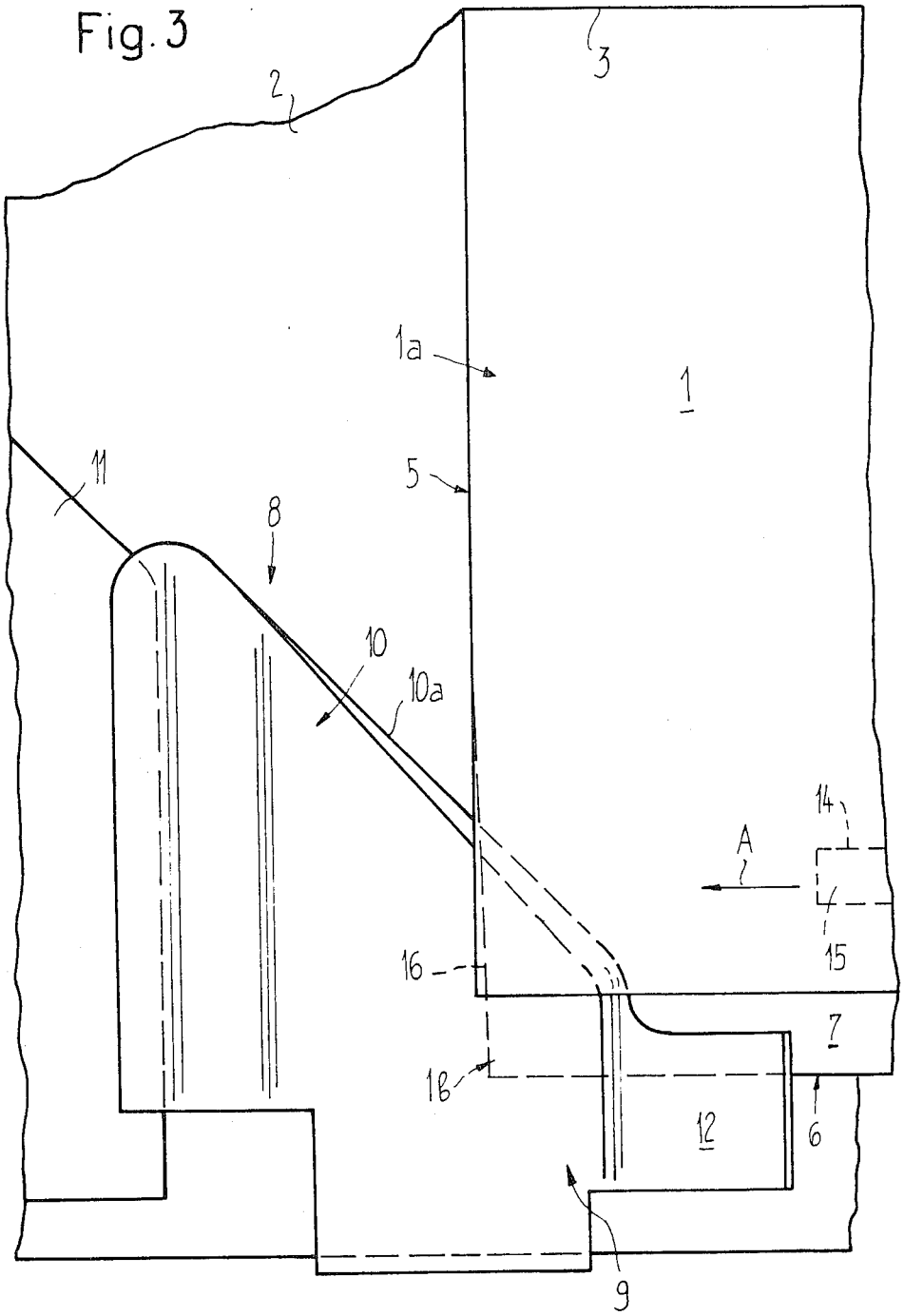
FIG. 3 is a top plan view of the opening device of the apparatus shown in FIG. 2 at a later stage with a more advanced position of the products in the apparatus.

Describing now the drawings, it will be evident therefrom that printed products 1 to be opened are formed by asymmetrically folded sheets which rest on a support or support member 2 with one flat side of the sheets thereof. The support member 2 may be constituted by a partition or separation wall separating radially extending cells of a cell wheel not here described in any further detail, but known in the art, for instance from U.S. Pat. No. 3,951,399. The asymmetrically folded printed product 1 has two parts or portions 1*a* and 1*b* which are interconnected by a fold 3 (see FIG. 3). The sheets of the product portions 1*a* and 1*b* are designated by reference numberals 4 and 4', respectively. The sides of the sheets neighbouring the fold 3 are open, that is the sheets are not interconnected at these sides; as to these sides only the leading side or edge 5 is shown. A side of the sheet which is also open is the side 6 opposite the fold 3. At the open side 6 the sheets 4' of the product part or portion 1*b* contain a marginal zone or portion 7 which protrudes past the sheets 4 of the other product part or portion 1*a*. The marginal zone or portion 7 extends over the entire length of the open side 6.

Figures 1, 2:
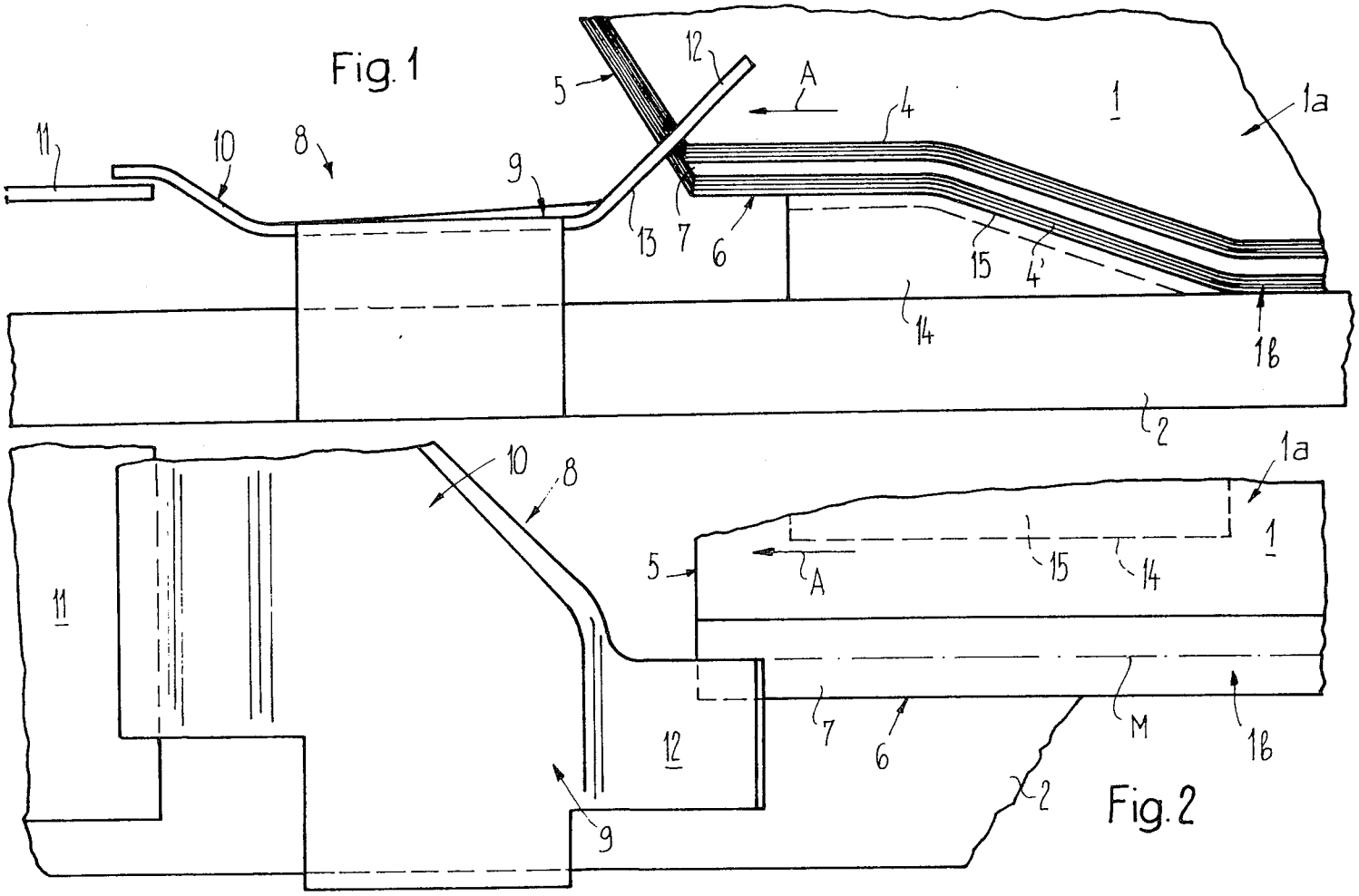
FIG. 1 is a side view, partially in perspective, of an exemplary embodiment of apparatus according to the invention with the product shown in a position where it contacts the opening element of the opening device thereof.
FIG. 2 is a top plan view of the apparatus shown in FIG. 1.

The printed products 1 are conveyed by means of feed or conveying means in the direction of the arrow A of FIG. 1. The feed or conveying means has not been shown in any detail since its construction is conventional, for instance may be of the type disclosed in the aforementioned U.S. Pat. Nos. 3,951,399 and 4,058,202.

A stationary opening device 8 is arranged in the path of travel of the printed products 1. This opening device 8 is connected to the support or support member 2 and is arranged at a predetermined distance above the latter. The opening device 8 comprises an opening element 9 and a support element or device 10 which is formed integrally with the opening element 9. The opening element 9 is disposed within the path of travel of the protruding marginal zone 7 of the printed products 1, while the support element 10 follows the opening element 9 and extends towards the fold 3 of the printed products 1. In the direction of travel A of the printed products 1 a flat product retaining or hold-open member 11 is arranged behind or downstream of the support element 10 and also extends at a distance from the support member 2. The opening element 9 has a deflecting element or deflector 12 including a deflecting face 13 which is directed towards the printed products 1 approaching the same. The leading edge of the protruding marginal zone 7 contacts the deflecting face 13 during operation of the apparatus.

A substantially wedge-shaped ramp 14 defining a run-on member precedes the opening device 8 as seen in the direction of product travel A. The ramp 14 is connected to the support member 2 and contains a run-on surface or ramp face 15 which rises towards the opening device 8 and forms a lifting or elevating face for the printed products 1.

With reference to the drawings there will now be explained the operation of the apparatus as described hereinbefore.

Figure 4:
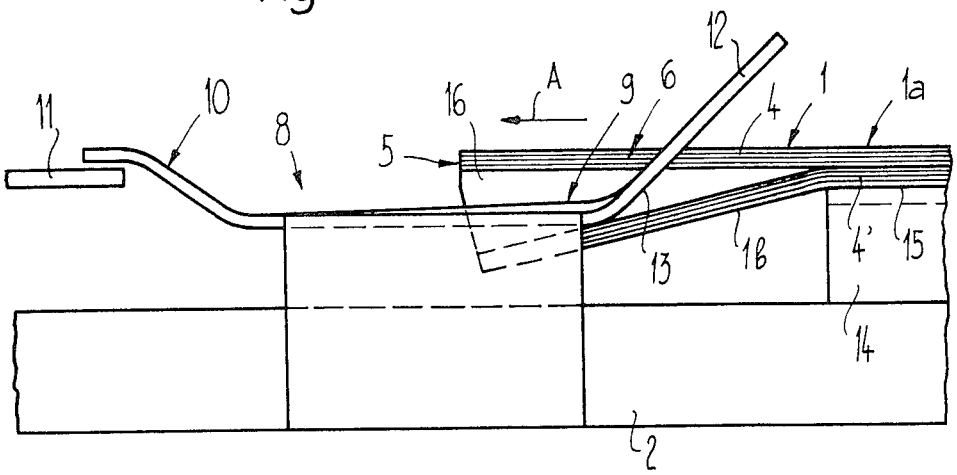
FIG. 4 is a side view of the opening device of the apparatus shown in FIG. 1 at a later stage with the product being shown in a more advanced position in the apparatus.
Figure 5:
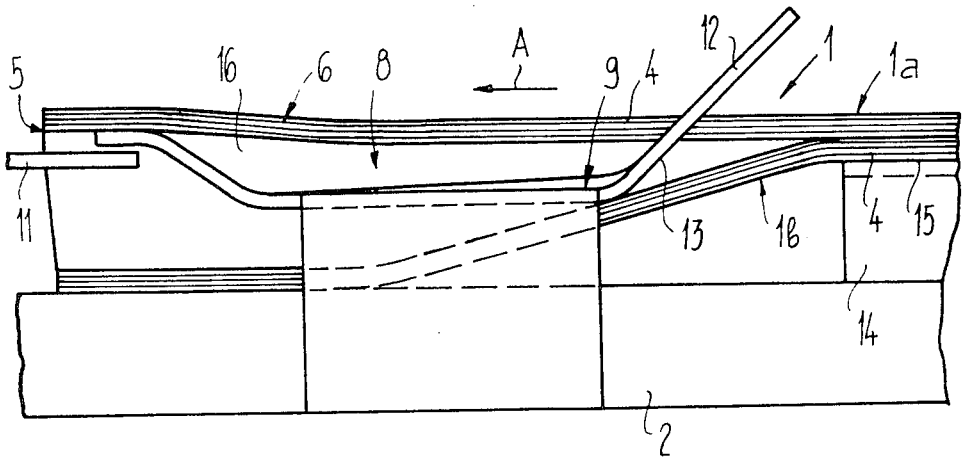
FIG. 5 is a side view corresponding to that shown in FIG. 4, with the product shown in a still more advanced position in the apparatus.

As will be apparent from FIGS. 1 and 2, the open side 5 of the printed product 1 travelling towards the opening device 8 is lifted by the ramp face 15 of the ramp 14. This results in the printed product 1 being elevated or lifted from the support member 2 at the region of the other open side 6. Upon further travel of the printed product 1 the sheets 4' which protrude past the sheets 4 of the product part or portion 1*a* contact the deflecting surface or face 13 at the inclined deflecting member 12 by means of the leading edge of the protruding marginal zone 7. Consequently, the sheets 4' are deflected downwardly towards the support member 2 by means of the deflecting member 12 as shown in FIGS. 4 and 5. The top part or portion 1*a* of the printed product 1 moves past the opening element 9 without being deflected from its path of travel, so that an opening 16 is formed between the product portions 1*a* and 1*b*. This opening 16 is entered by the support element or device 10 upon which the sheets 4 of the product portion 1*a* come to rest. The support element 10 has a front edge 10*a* (FIG. 3) extending at an angle with respect to the path of travel A of the products 1. During the passage of the printed product 1 through the opening device 8 the opening element 9 acts continuously upon the protruding marginal zone or portion 7 which extends essentially parallel to the path of travel A. Hence, the sheets 4' of the bottom product portion 1*b* are continuously deflected and run below the opening device 8.

After having passed the support element or device 10 the top portion 1*a* of the printed product 1 will come to rest upon the retaining or hold-open member 11 which follows the support element 10. The retaining member 11 ensures that the two product portions 1*a* and 1*b* will remain separated from one another. Further printed products, as described in detail in the aforementioned U.S. Pat. No. 3,951,399, may then be inserted or stuffed into the printed product 1 thus opened.

By the deflection of the sheets 4' having a protruding marginal zone or portion 7 from the other sheets 4 by means of the opening element 9 an opening 16 can be reliably formed between the product parts or portions 1*a* and 1*b* and with the aid of very simple means, namely the stationary opening device 8. Such opening is formed both with very thin printed products 1 as well as with thick printed products 1. If the deflecting member 12 is aligned to the theoretical central line of the protruding marginal zone 7 which is shown by dash-dotted lines and designated by reference character M in FIG. 2, then the protruding marginal zone 7 will be faultlessly detected or acted upon by the opening element 9, and thus there is ensured for positive opening of the product even when the width of the marginal zone or portion 7 changes.

It should be understood that the opening device 8 as described hereinbefore may be designed differently with respect to some of its parts or components. Some of these variant constructions are referred to in the following description.

The opening element 9 which acts on the protruding marginal zone 7 does not have to be formed integrally or of one-piece with the support element 10, but may also be provided separately therefrom. Above all this will be convenient in cases in which the support element 10 is formed of one-piece with the subsequently arranged retaining member 10. The embodiment as described hereinbefore, however, has the advantage over the last-mentioned construction that the opening element 9 and the support element 10, i.e. the opening device 8 may be exchanged without having to disassemble the usually much larger retaining member 11. On the other hand, the embodiment as heretofore described can be readily retrofitted into an already present cell wheel.

It will be understood that the apparatus as described hereinbefore may also be used for the opening of multi-sheet printed products in which the sheets are interconnected at one side thereof, instead of by folding, in any other suitable manner, such as for example by binding, stitching, glueing or the like. Furthermore, multi-sheet products other than printed products also can be opened in the manner heretofore described.

As already mentioned hereinbefore, the opening device as previously described is particularly suited to be installed in apparatus for handling printed products which may be of the type comprising a cell wheel arranged to be rotated about an axis. Cell wheels of this kind are described in detail in the aforementioned U.S. Pat. Nos. 3,951,399 and 4,058,202. Opening apparatus of the kind as described hereinbefore will be disposed within each cell of the cell wheel, preferably in the input section thereof. It will be, however, readily evident that the opening apparatus as described above may also be employed in a different way.

While there are shown and described present preferred embodiments of the invention, it is to be distinctly understood that the invention is not limited thereto, but may be otherwise variously embodied and practiced within the scope of the following claims. Accordingly,

What I claim is:

1. A method of opening a product, especially a printed product, comprising at least two superposed sheets interconnected at a first side thereof and one sheet thereof being provided at a second side thereof with a marginal zone protruding past a margin at the corresponding second side of the other one of said at least two superposed sheets, said method comprising the steps of:

placing said product comprising said at least two superposed sheets on a support with the sheet provided with said protruding marginal zone lying upon said support;

moving said product relative to an opening device containing an opening element in a predetermined direction of travel with an open side of the product leading and moving towards said opening element;

raising said product prior to contacting said opening element;

bringing said protruding marginal zone of the product into engagement with said opening element of said opening device; and deflecting said sheet having said protruding marginal zone by means of said opening element downwardly from the other sheet of said product lying thereabove, so that said at least two sheets of said product are opened and spaced apart as said product is moved relative to said opening device.

2. The method as defined in claim 1, wherein:

said product having at least two sheets comprises at least one asymmetrically folded sheet.

3. The method as defined in claim 1, further including the steps of:

moving said product in a direction extending approximately parallel to the lengthwise direction of the protruding marginal zone towards the opening element and past the latter.

4. The method as defined in claim 3, further including the steps of:

aligning said opening element of said opening device substantially in the direction of an imaginary central line extending through said protruding marginal zone.

5. The method as defined in claim 1, wherein:

a ramp face is arranged to precede said opening device; and said product is raised above the level of said support by being moved relative to said ramp face.

6. The method as defined in claim 1, further including the steps of:

introducing a support element into an opening formed between the opened sheets and upon which comes to rest the sheet devoid of a protruding marginal zone.

7. The method as defined in claim 1, wherein:

the step of raising said product prior to contacting said opening element includes the step of elevating the entire said product in order to enable the opening element to downwardly deflect said one sheet of said product by engaging the protruding marginal zone thereof.

8. An apparatus for opening a product, especially a printed product, comprising at least two superposed sheets interconnected at a first side thereof and one sheet thereof being provided at a second side thereof with a marginal zone protruding past a margin at the corresponding second side of the other one of said at least two superposed sheets, said apparatus comprising:

a support for supporting said product, which comprises said at least two superposed sheets and which moves in a predetermined direction of travel, with said one sheet thereof provided with said protruding marginal zone lying upon said support;

an opening device including an opening element adapted to engage said protruding marginal zone of said one sheet;

means including a run-on surface for said product arranged forwardly of said opening element and ascending from said support towards said opening element; and said opening element downwardly deflecting said one sheet provided with the protruding marginal zone towards said support by engaging said protruding marginal zone.

9. The apparatus as defined in claim 8, further including:

means for supporting said opening element in spaced relationship above said support.

10. The apparatus as defined in claim 9, wherein:

said printed product is moved in a direction towards said opening element which extends approximately parallel to the lengthwise extent of its protruding marginal zone and is moved past said opening element.

11. The apparatus as defined in claim 8, wherein:

said printed product is moved in a direction towards said opening element which extends approximately parallel to the lengthwise extent of its protruding marginal zone and is moved past said opening element.

12. The apparatus as defined in claim 8, wherein:

said opening device includes a support element arranged following said opening element;

said support element being insertable into an opening formed by the opening element between said sheets; and the sheet devoid of the protruding marginal zone bearing upon said support element.

13. The apparatus as defined in claim 8, wherein:

said opening element includes a deflector element arranged in the path of travel of the protruding marginal zone of the product and directed towards the product travelling towards said deflector element; and said deflector element serving to deflect the sheet containing the protruding marginal zone towards said support.

14. The apparatus as defined in claim 12, wherein:

said opening element and said support element are formed of one-piece.

15. The apparatus as defined in claim 12, further including:

a retaining element for holding open the product and which is arranged after the support element with respect to the direction of travel of the product; and said retaining element being insertable between the sheets of the product.

16. The apparatus as defined in claim 14, further including:

a retaining element for holding open the product arranged after the opening element with respect to the direction of travel of the product; and said retaining element being insertable between the sheets of the product.

17. The apparatus as defined in claim 8, wherein:

said means including a run-on surface for said product and arranged forwardly of said opening element is provided with a run-on surface structured for elevating the entire said product in order to downwardly deflect the one sheet of said product when the opening element engages the protruding marginal zone of said one sheet.

18. An apparatus for opening a product, especially a printed product, comprising at least two superposed sheets interconnected at a first side thereof and one sheet thereof being provided at a second side thereof with a marginal zone protruding past a margin at the corresponding second side of the other one of said at least two superposed sheets, said apparatus comprising:

support means for supporting said product comprising said at least two superposed sheets directly at said one sheet which includes said protruding marginal zone;

an opening element facing an open side of the product and being arranged in alignment with said marginal zone protruding from said one sheet; and said opening element comprising a deflecting element for deflecting said one sheet having said protruding marginal zone in a downward direction.

19. The apparatus as defined in claim 18, wherein:

said opening element is disposed above said support means.

20. The apparatus as defined in claim 19, further including:

product run-on means including a ramp face which ascends in a direction towards said opening element and arranged to precede said opening element.

21. The apparatus as defined in claim 20, further including:

a support element following said opening element for supporting the open product at the sheet thereof devoid of a protruding marginal zone.

* * * * *